US006422310B2

(12) United States Patent
Egara

(10) Patent No.: US 6,422,310 B2
(45) Date of Patent: Jul. 23, 2002

(54) CONSTANT TEMPERATURE COOLANT CIRCULATING APPARATUS

(75) Inventor: Yoshitaka Egara, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 09/848,317

(22) Filed: May 4, 2001

(30) Foreign Application Priority Data

Jul. 19, 2000 (JP) ..... 2000-218912

(51) Int. Cl.[7] ..... F25B 29/00; F25D 13/00

(52) U.S. Cl. ..... 165/281; 165/278; 165/283; 165/48.1; 165/50; 165/108; 165/263; 62/201; 62/434; 62/435

(58) Field of Search ..... 165/281, 50, 481, 165/283, 278, 108, 263; 62/201, 434, 435

(56) References Cited

U.S. PATENT DOCUMENTS 3,885,620 A * 5/1975 Von Cleve ..... 165/50
4,045,961 A * 9/1977 Schoonman ..... 165/281
4,151,874 A * 5/1979 Kaburagi et al. ..... 165/281
4,158,384 A * 6/1979 Brautigam ..... 165/281
4,657,068 A * 4/1987 Peltz ..... 165/47
5,148,684 A * 9/1992 Leimbach et al. ..... 62/197
5,749,237 A * 5/1998 Sandofsky et al. ..... 62/209
5,960,857 A * 10/1999 Oswalt et al. ..... 165/263
6,003,595 A * 12/1999 Watanabe ..... 165/263
6,044,903 A * 4/2000 Heilman et al. ..... 165/263
6,233,955 B1 5/2001 Egara

FOREIGN PATENT DOCUMENTS

| | | |
|---|---|---|
| GB | 2 353 586 | 2/2001 |
| JP | 10-141831 | 5/1998 |
| JP | 10-220947 | 8/1998 |

* cited by examiner

*Primary Examiner*—John K. Ford
(74) *Attorney, Agent, or Firm*—Oblon, Spivak, McClelland, Maier & Neustadt, P.C.

(57) ABSTRACT

A check valve 27 for preventing backflow of a coolant 5 in outside pipes 14*a* and 14*b* into a tank 10 when operation is stopped, a cubical expansion relief valve 28 for suppressing increase of pressure of the coolant in the outside pipes 14*a* and 14*b*, and a purge check valve 29 for blowing compressed gas into the outside pipes 14*a* and 14*b* to recover the coolant are connected to a primary-side flow path for sending the coolant 5 to a heat load 1, a flow rate control valve 31 for controlling a flow rate or pressure of the coolant is connected to a secondary-side flow path for receiving the coolant 5 from the heat load 1, a bypass flow path 35 is provided between the primary-side flow path and the secondary-side flow path, and a bypass flow rate control valve 36 which opens when the pressure of the coolant in the outside pipes 14*a* and 14*b* exceeds prescribed pressure is connected in the bypass flow path 35.

3 Claims, 4 Drawing Sheets

CONSTANT TEMPERATURE COOLANT CIRCULATING APPARATUS

TECHNICAL FIELD

The present invention relates to a constant temperature coolant circulating apparatus for supplying a constant temperature coolant to a heat load in a circulating manner to cool the heat load.

PRIOR ART

As this type of a constant temperature coolant circulating apparatus, there is a known apparatus formed of a coolant circuit for supplying a coolant to a heat load in a circulating manner, a refrigerating circuit for cooling the coolant a temperature of which has increased by cooling the heat load by exchanging heat with refrigerant in a heat exchanger, and a control portion for controlling these circuits, for example.

The coolant circuit has a tank in which the coolant is accommodated and the coolant in the tank is supplied to the heat load by a pump. After the coolant a temperature of which has increased by cooling the heat load flows back to the heat exchanger in the refrigerating circuit and is cooled, the coolant flows into the tank and is supplied to the load again.

The heat load is normally connected to such a circulating apparatus through outside pipes prepared by a user. However, the kind of heat load, a heat capacity, and a place at which the apparatus is installed are not necessarily fixed but are diversely different depending on the user. Therefore, the outside pipes are extremely long and have large capacities or are risers and in higher positions than the circulating apparatus in some cases, which is liable to cause a problem of backflow of the coolant in the outside pipes into the circulating apparatus and overflowing of the coolant from the tank when operation of the apparatus is stopped. If the low-temperature coolant is kept encapsulated in the outside pipes when operation is stopped, volume of the coolant increases due to increase of the temperature of the coolant to a room temperature and pressure in the outside pipes may become abnormally high pressure- to break the pipes. Furthermore, in maintenance and inspections of the outside pipes and the load, it is required to safely and reliably discharge and recover the coolant in the outside pipes by a simple method.

DISCLOSURE OF THE INVENTION

It is a main technical object of the invention to provide a constant temperature coolant circulating apparatus which can solve all of the problems of the above-described prior-art apparatus and has excellent safety.

To achieve the above object, in a circulating apparatus of the present invention, a check valve for preventing backflow of a coolant in an outside pipe into the circulating apparatus when operation is. stopped and a cubical expansion relief valve which opens to let a part of the coolant flow back to the circulating apparatus when pressure of the coolant in the outside pipe increases excessively are connected in parallel to each other and a purge check valve for blowing compressed gas into the outside pipe in recovering the coolant in the outside pipe is connected in a primary-side flow path for sending the coolant to a heat load through the outside pipe.

In such a circulating apparatus of the invention, when operation of the apparatus is stopped, backflow of the coolant in the outside pipe can be prevented by operation of the check valve. Besides, even if volume of the coolant increases due to a temperature rise of the coolant encapsulated in the outside pipe and internal pressure of the outside pipe increases, a part of the coolant flows back to the circulating apparatus by operation of the cubical expansion relief valve before the internal pressure becomes abnormally high pressure and breakage of the outside pipe is prevented. In maintenance and inspections of the outside pipe and the load, by blowing compressed gas into the outside pipe through the purge check valve, the coolant in the outside pipe can be discharged and recovered safely and reliably by a simple method.

In the invention, it is preferable that a flow rate control valve for controlling a flow rate or pressure of the circulating coolant is connected in the secondary-side flow path of the circulating apparatus, a recovering port for recovering the coolant in the outside pipe in another vessel is provided in a position closer to an outside pipe connecting hole than a position in which the flow rate control valve is connected, a bypass flow path connecting the secondary-side flow path and the primary-side flow path is provided between both the flow paths, and a bypass flow rate control valve which opens to let a part of the coolant in the primary-side flow path flow into the secondary-side flow path when the pressure of the coolant in the outside pipe exceeds prescribed pressure during operation is connected in the bypass flow path.

As a result, the flow rate or pressure of the coolant can be controlled by the flow rate control valve according to a capacity of the heat load. Besides, in recovering the coolant in the outside pipe, if it is necessary to recover the coolant in another vessel without causing the coolant to flow back to the tank of the circulating apparatus, the flow rate adjusting valve is closed and the recovering port is opened to thereby recover the coolant in another vessel through the recovering port. When the pressure of the coolant in the outside pipe exceeds the prescribed pressure, it is possible to relieve the pressure to the secondary side through the bypass flow path and the bypass flow rate control valve to thereby further improve safety.

According to a preferable concrete embodiment of the invention, a combination valve unit is formed by integrally connecting a supply junction pipe and a return junction pipe which form parts of the primary-side flow path and the secondary-side flow path, the check valve, the cubical expansion relief valve, the purge check valve, the flow rate control valve, the recovering port, the bypass flow path, and the bypass flow rate control valve, a primary-side main pipe connecting hole and a secondary-side main pipe connecting hole which can be detachably connected to a supply main pipe and a return main pipe of the circulating apparatus and a pipe connecting hole to which the outside pipe can be detachably connected are provided to the combination valve unit, and the heat load is connected to the circulating apparatus through the combination valve unit.

DETAILED DESCRIPTION

Figure 1:
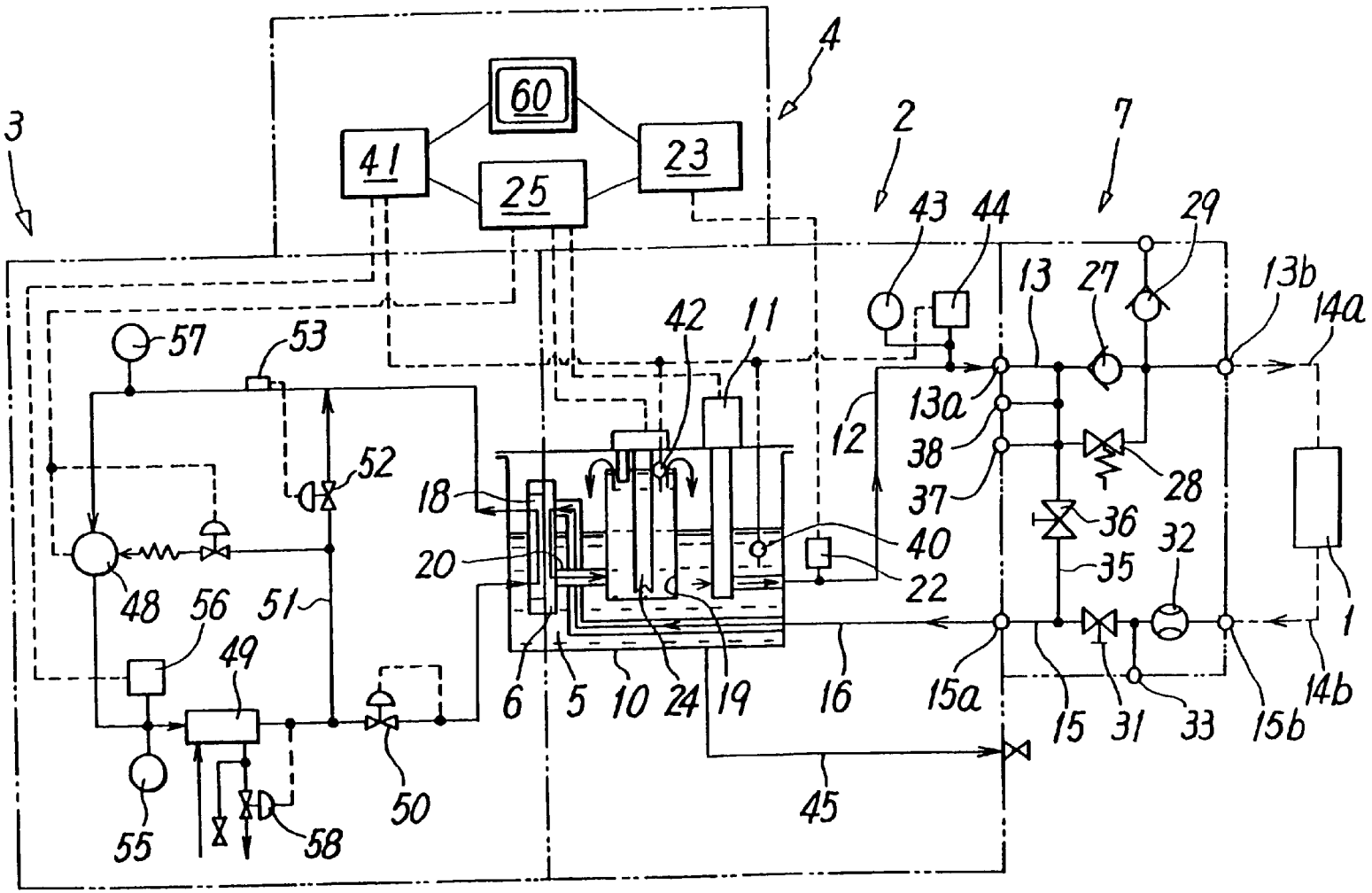
FIG. 1 is a block diagram showing an embodiment of a constant temperature coolant circulating apparatus according to the present invention.

FIG. 1 shows a preferable representative embodiment of a constant temperature coolant circulating apparatus according to the present invention. The circulating apparatus includes a coolant circuit 2 for supplying coolant 5 to a heat load 1 in a circulating manner, a refrigerating circuit 3 for cooling the coolant 5 a temperature of which has been increased by cooling the heat load 1 by causing the coolant 5 to exchange heat with a refrigerant in a heat exchanger 6, and a control portion 4 for controlling the circuits 2 and 3.

The coolant circuit 2 has a tank 10 in which the coolant 5 at a controlled temperature is accommodated. The coolant 5 in the tank 10 is supplied to the heat load 1 by a pump 11 through a supply main pipe 12 and a supply junction pipe 13 of a combination valve unit 7 forming a primary-side flow path and by an outside pipe 14*a*. The coolant 5 a temperature of which has been increased by cooling the heat load 1 flows from the outside pipe 14*b* through a return junction pipe 15 of the combination valve unit 7 and a return main pipe 16 forming a secondary-side flow path back to a heat exchanger 6. Then, after the coolant 5 is cooled in the heat exchanger 6 by exchanging heat with the refrigerant flowing in an evaporator 18 in the refrigerating circuit 3, the coolant 5 flows into an inner vessel 19 provided in the tank 10 and having an open upper portion through an outlet pipe 20, overflows the inner vessel 19, flows into the tank 10, and is supplied to the heat load 1 again.

A temperature sensor 22 for measuring a temperature of the coolant 5 supplied to the heat load 1 is disposed in a vicinity of an outlet of the tank 10 and is connected to a first control circuit 23 in the control portion 4. A heater 24 for heating the coolant 5 is provided in the inner vessel 19 and is connected to a second control circuit 25 in the control portion 4. If the temperature of the coolant 5 measured by the temperature sensor 22 is lower than a set temperature, a signal is output from the first control circuit 23 to the second control circuit 25 to turn the heater 24 on to heat the coolant 5 to the set temperature.

The supply junction pipe 13 of the combination valve unit 7 is provided with a primary-side main pipe connecting hole 13*a* to be detachably connected to the supply main pipe 12 and a primary-side pipe connecting hole 13*b* to which the outside pipe 14*a* is detachably connected. Between the connecting holes 13*a* and 13*b*, a check valve 27 for preventing backflow of the coolant 5 in the outside pipes 14*a* and 14*b* to the circulating apparatus when operation of the circulating apparatus is stopped and a cubical expansion relief valve 28 which opens to let a part of the coolant 5 flow back to the circulating apparatus when pressure of the coolant 5 in the outside pipes 14*a* and 14*b* becomes abnormally high pressure are connected in parallel to each other and a purge check valve 29 for blowing compressed gas such as nitrogen into the outside pipes 14*a* and 14*b* in recovering the coolant 5 in the outside pipes 14*a* and 14*b* is connected in a position closer to the pipe connecting hole 13*b* than the check valve 27 and the cubical expansion relief valve 28.

On the other hand, the return junction pipe 15 of the combination valve unit 7 is provided with a secondary-side main pipe connecting hole 15*a* to be detachably connected to the return main pipe 16 and a secondary-side pipe connecting hole 15*b* to which the outside pipe 14*b* is detachably connected. Between the connecting holes 15*a* and 15*b*, a flow rate control valve 31 for controlling a flow rate or pressure of the circulating coolant 5 and a flow rate sensor 32 are connected in series and a recovering port 33 for recovering the coolant 5 in the outside pipes 14*a* and 14*b* in another vessel is provided in a position between the flow rate control valve 31 and the flow rate sensor 32. A hand-operated valve (not shown) can be connected to the recovering port 33. Between the return junction pipe 15 and the supply junction pipe 13, a bypass flow path 35 connecting both the junction pipes 13 and 15 is provided between a position closer to the main pipe connecting hole 15*a* than the flow rate control valve 31 and a position closer to the main pipe connecting hole 13*a* than the check valve 27 and the cubical expansion relief valve 28. In the bypass flow path 35, a bypass flow rate control valve 36 which opens when pressure of the coolant 5 in the outside pipes 14*a* and 14*b* exceeds prescribed pressure during operation of the circulating apparatus to relieve primary-side pressure to a secondary side to reduce the pressure is connected.

Figure 2:
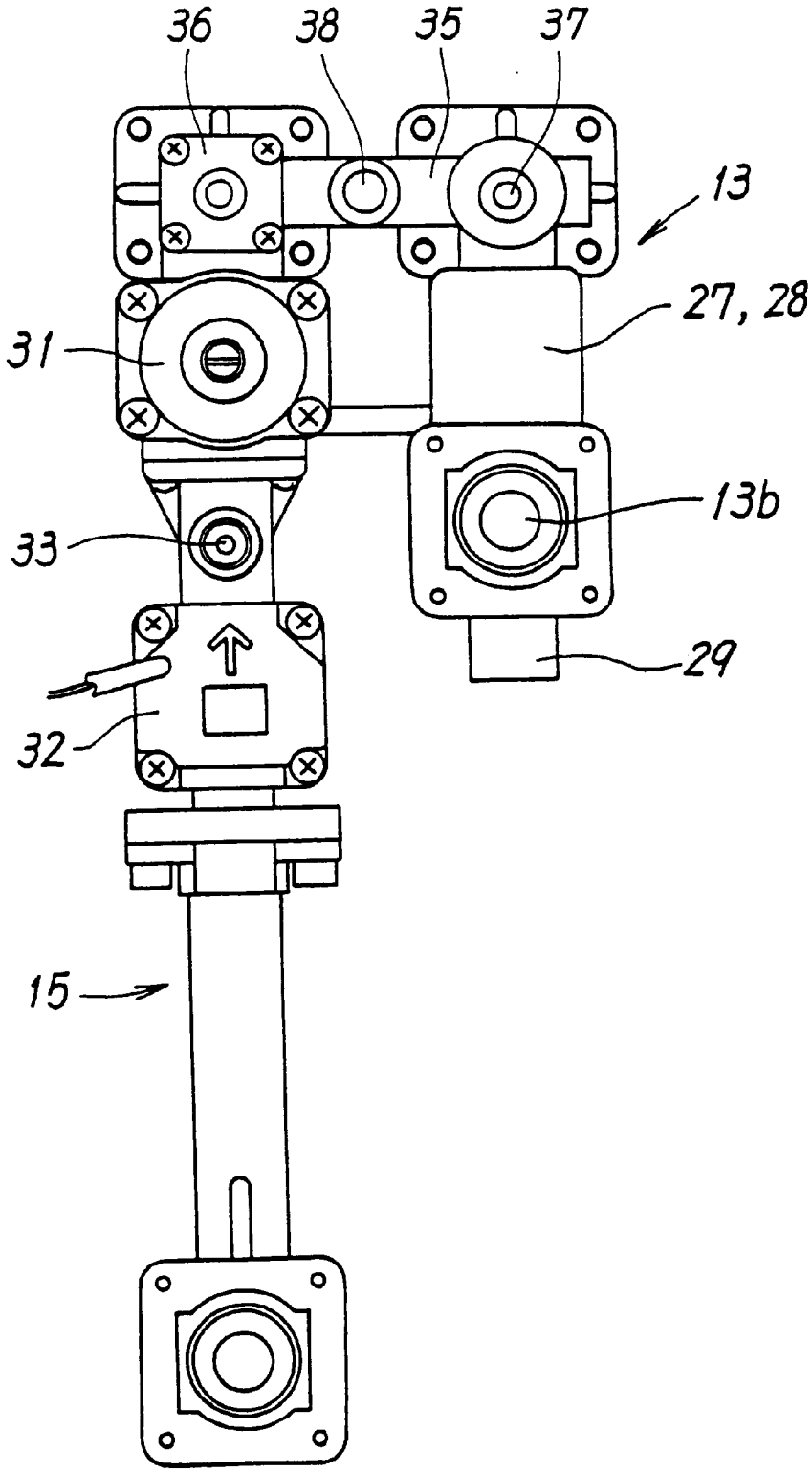
FIG. 2 is a front view of a combination valve unit used for the circulating apparatus.
Figure 3:
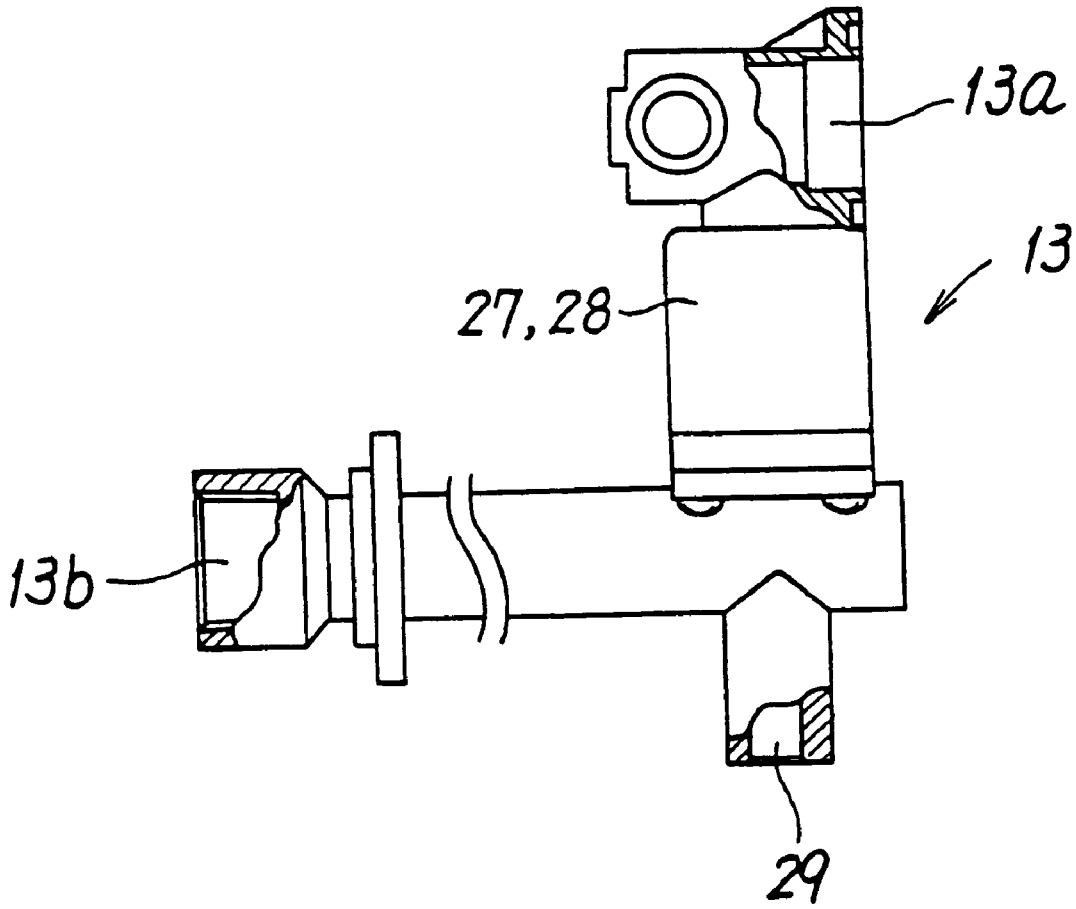
FIG. 3 is a right side view of the combination valve unit showing a primary-side flow path only.
Figure 4:
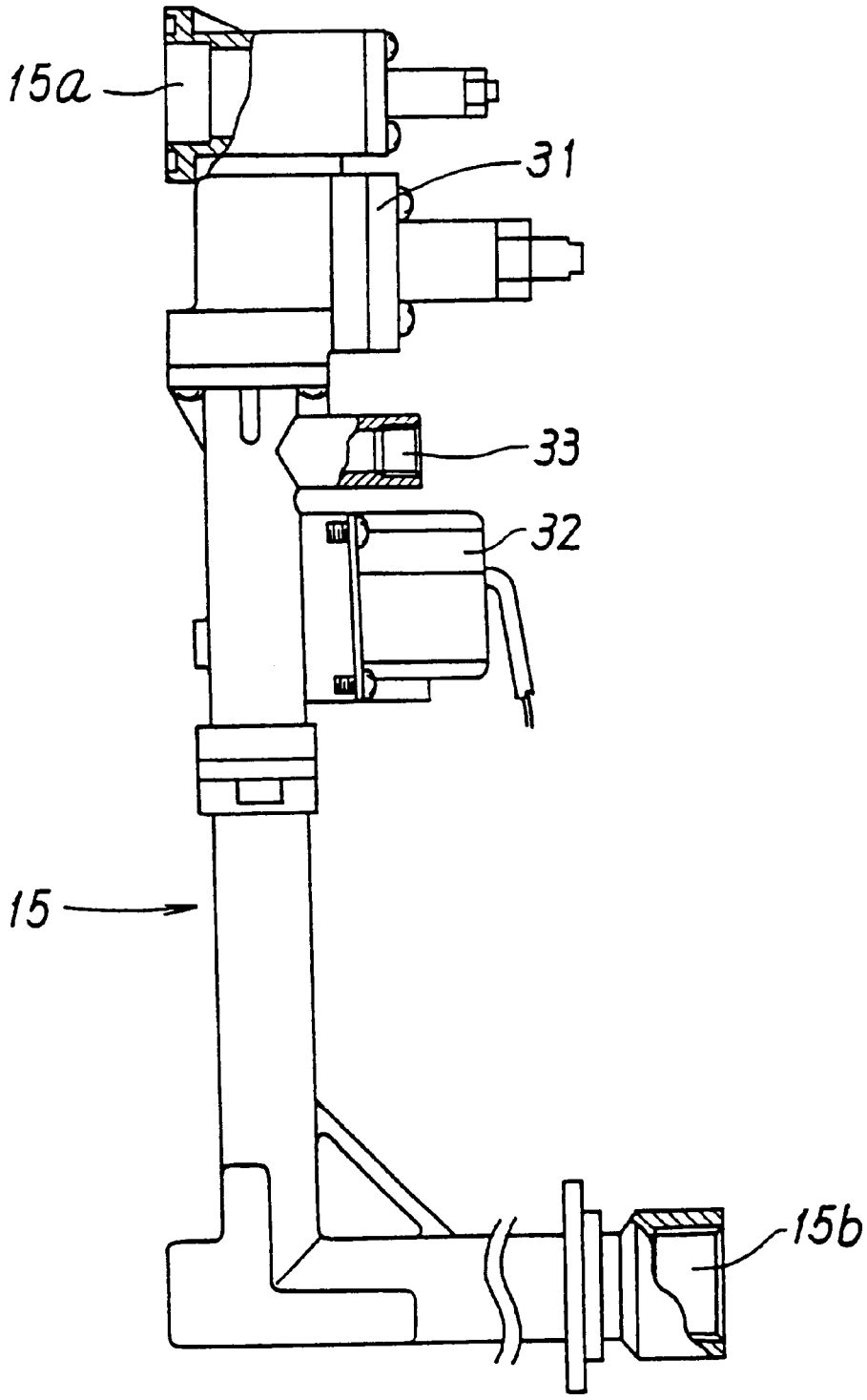
FIG. 4 is a left side view of the combination valve unit showing a secondary-side flow path only.

The combination valve unit 7 is formed by integrally connecting the supply junction pipe 13, the return junction pipe 15, the check valve 27, the cubical expansion relief valve 28, the purge check valve 29, the flow rate control valve 31, the recovering port 33, the bypass flow path 35, and the bypass flow rate control valve 36 as shown in FIGS. 2 to 4. The combination valve unit 7 is detachably connected to the supply main pipe 12 which is a primary-side flow path of the circulating apparatus and the return main pipe 16 which is a secondary-side flow path. To the combination valve unit 7, the heat load 1 is connected through the outside pies 14*a* and 14*b*.

In the bypass flow path 35, a port 37 to which a temperature sensor is connected and a port 38 to which a pressure gauge is connected are provided in positions closer to the supply junction pipe 13 than the bypass flow rate control valve 36. It is possible to respectively connect the temperature sensor 22 and a pressure gauge 43 connected to the supply main pipe 12 to the respective ports 36 and 37 without connecting the temperature sensor 22 and the pressure gauge 43 to the supply main pipe 12. In this case, a low-pressure cut switch 44 is also connected to the port 38 with the pressure gauge 43.

In the drawing, a reference numeral 40 designates a level switch for detecting a liquid level of the coolant 5 in the tank 10 to output a detection signal to a third control circuit 41 of the control portion 4, 42 a level switch for detecting a liquid level of the coolant 5 in the inner vessel 19 to similarly output a detection signal to the third control circuit 41, 43 the pressure gauge for detecting pressure of the coolant 5 sent into the heat load 1, 44 the low-pressure cut switch for outputting a cut signal of the coolant 5 to the third control circuit 41 when the pressure detected by the pressure gauge 43 becomes equal to or smaller than a certain value, and 45 a drain pipe for draining off the coolant 5 in the tank 10.

On the other hand, the refrigerating circuit 3 compresses the refrigerant which has been evaporated by heat exchange with the coolant 5 in the evaporator 18 to thereby turn the refrigerant into high-temperature and high-pressure refrigerant gas in a compressor 48. Then, the refrigerating circuit 3 cools and condenses the refrigerant gas in a condenser 49 to thereby turn the refrigerant gas into a high-pressure liquid refrigerant, reduces pressure of the liquid refrigerant in a constant pressure expansion valve 50 to thereby bring down a temperature of the liquid refrigerant, and supplies the liquid refrigerant to the evaporator 18.

The refrigerating circuit 3 also includes a back-flow circuit 51 for causing a part of the refrigerant condensed in the condenser 49 to directly flow back to an inlet side of the compressor 48 without allowing the part of refrigerant to flow into the constant pressure expansion valve 50 when an outlet temperature of the evaporator 18 is higher than usual and a temperature-type expansion valve 52 for adjusting an amount of refrigerant. circulating in the back-flow circuit 51. The temperature-type expansion valve 52 is controlled by a temperature sensor 53 for detecting a temperature of the refrigerant flowing back to the compressor 48. An opening degree of the expansion valve 52 increases to cause the refrigerant from the condenser 49 to flow through the back-flow circuit 51 to thereby bring down the temperature of the refrigerant when the temperature of the refrigerant drawn into the compressor 48 increases.

A flow path between the compressor 48 and the condenser 49 in the refrigerating circuit 3 is provided with a high-pressure refrigerant pressure gauge 55 for detecting pressure of the high-temperature and high-pressure refrigerant gas and a high-pressure refrigerant cut switch 56 for outputting a cut signal to the third control circuit 41 when the pressure of the refrigerant gas exceeds predetermined pressure. A low-pressure refrigerant pressure gauge 57 for detecting pressure of low-pressure refrigerant gas is provided on an inlet (back-flow) side of the refrigerant gas-of the compressor 48. The condenser 49 is provided with a pressure sluice valve 58 for adjusting a flow rate of cooling water supplied to the condenser 49.

The control portion 4 includes the above-described first to third control circuits 23, 25, and 41 and an operation display portion 60. The first control circuit 23 sends a signal to the second control circuit 25 based on the coolant temperature measured by the temperature sensor 22 and has a function of adjusting the coolant temperature by operation of the heater 24 as described above.

The second control circuit 25 is formed of devices such as an electromagnetic contractor, an electromagnetic switch, or a solid-state relay, operates when the circuit 25 receives signals from the first control circuit 23 and e third control circuit 41, and controls the compressor 48, the pump 11, and the heater 24 by the above devices.

The third control circuit 41 is formed as a programmable logical controller (PLC) and outputs signals to the second control circuit 25 and the operation display portion 60 in response to signals from the level switch 40 in the tank 10, the level switch 42 in the inner vessel 19, the low-pressure cut switch 44, the high-pressure refrigerant cut switch 56, and the like.

The operation display portion 60 can set the temperature of the coolant 5 supplied to the heat load 1. The set temperature and the measured temperature measured by the temperature sensor 22 are displayed on the operation display portion 60 by proper means and output to the first control circuit 23 and the third control circuit 41. The set temperature can be changed by touching a panel.

In the circulating apparatus having the above structure, the temperature of the coolant 5 supplied to the heat load 1 increases by cooling of the heat load 1 by the coolant 5. The coolant 5 a temperature of which has increased is cooled to the set temperature by exchanging heat with the refrigerant in the refrigerating circuit 3 in the heat exchanger 6 and is temporarily accommodated in the tank 10 through the inner vessel 19. Then, the coolant 5 is supplied to the heat load 1 again by the pump 11.

The temperature of the coolant 5 is measured by the temperature sensor 22 provided to the primary-side flow path. If the temperature is lower than the set temperature, the heater 24 is turned on to heat the coolant 5 and the temperature is adjusted so as to be the set temperature.

If operation of the circulating apparatus is stopped and if the outside pipes 14*a* and 14*b* are risers and in higher positions than the circulating apparatus, for example, because backflow of the coolant 5 in the outside pipes 14*a* and 14*b* to the circulating apparatus is prevented by operation of the check valve 27, a problem of an overflow of backward flowing circulating liquid from the tank 10 does not occur. If the low-temperature coolant 5 is encapsulated in the outside pipes 14*a* and 14*b* by closing of the respective valves, though the temperature of the coolant 5 increases due to room temperature and volume of the coolant 5 increases and internal pressure of the outside pipes 14*a* and 14*b* increases, a part of the coolant 5 flows back to the circulating apparatus by operation of the cubical expansion relief valve 28 and the pressure reduces to thereby reliably prevent breakage of the. outside pipes 14*a* and 14*b*.

Furthermore, in order to discharge the coolant 5 in the outside pipes 14*a* and 14*b* or the heat load 1 to maintain and inspect the outside pipes 14*a* and 14*b* or the heat load 1, it is possible to reliably cause the coolant 5 in the outside pipes 14*a* and 14*b* to flow back to the tank 10 through the secondary-side flow path and to recover the coolant 5 by blowing compressed gas such as nitrogen into the outside pipes 14*a* and 14*b* through the purge check valve 29. At this time, because backflow of the coolant 5 in the outside pipes 14*a* and 14*b* toward a supply line of the compressed gas is prevented by operation of the purge check valve 29, the coolant 5 can be recovered safely. If it is necessary to recover the coolant 5 in the outside pipes 14*a* and 14*b* in another vessel in connection with capacity of the tank 10, it is possible to recover the coolant 5 in another vessel through the recovering port 33 by closing the flow rate control valve 31 in the return junction pipe 15.

On the other hand, the flow rate control valve 31 connected to the return junction pipe 15 can adjust the flow rate or pressure of the coolant 5 to a proper value according to capacity of the heat load 1 by closing the flow rate control valve 31 when the flow rate of the circulating coolant 5 is excessively high or when the pressure of the coolant 5 is excessively low.

In contrast, if flow path resistance of the outside pipes 14*a* and 14*b* is large and the coolant 5 is less liable to flow, the pressure on the primary-side flow path increases. In this case, by opening the bypass flow rate control valve 36 to let the a part of the coolant 5 in the primary-side flow path to escape into the secondary-side flow path through the bypass flow path 35, the pressure of the primary-side flow path can be reduced.

As described above, according to the invention, it is possible to obtain a constant temperature coolant circulating apparatus with excellent safety and usability.

What is claimed is:

1. A constant temperature coolant circulating apparatus for supplying a coolant in a circulating manner to a heat load connected through an outside pipe to cool said heat load, a temperature of said coolant being controlled, wherein said circulating apparatus comprises a primary-side flow path for sending said coolant to said heat load through said outside pipe and a secondary-side flow path for receiving said coolant flowing back from said heat load through said outside pipe, a check valve for preventing backflow of said coolant in said outside pipe into said circulating apparatus when operation is stopped and a cubical expansion relief valve which opens to let a part of said coolant flow back to said circulating apparatus when pressure of said coolant in said outside pipe increases excessively are connected in parallel to each other and a purge check valve for blowing compressed gas into said outside pipe in recovering said coolant in said outside pipe is connected in said primary-side flow path.

2. A circulating apparatus according to claim 1, wherein a flow rate control valve for controlling a flow rate or pressure of said circulating coolant is connected to said secondary-side flow path, a recovering port for recovering said coolant in said outside pipe in another vessel is provided in a position closer to an outside pipe connecting hole than a position in which said flow rate control valve is connected, a bypass flow path connecting said secondary-side flow path and said primary-side flow path is provided, and a bypass flow rate control valve which opens to let a part of said coolant in said primary-side flow path flow into said secondary-side flow path when said pressure of said coolant in said outside pipe exceeds prescribed pressure is connected in said bypass flow path.

3. A circulating apparatus according to claim 2, wherein a combination valve unit is formed by integrally connecting a supply junction pipe and a return junction pipe which are parts of said primary-side flow path and said secondary-side flow path, said check valve, said cubical expansion relief valve, said purge check valve, said flow rate control valve, said recovering port, said bypass flow path, and said bypass flow rate control valve, a primary-side main pipe connecting hole and a secondary-side main pipe connecting hole which can be detachably connected to a supply main pipe and a return main pipe of said circulating apparatus and a pipe connecting hole to which said outside pipe can be detachably connected are provided to said combination valve unit, and said heat load is connected to said circulating apparatus through said combination valve unit.

* * * * *